US005393652A

United States Patent [19]

Marui

[11] Patent Number: 5,393,652

[45] Date of Patent: Feb. 28, 1995

[54] SILVER HALIDE PHOTOGRAPHIC LIGHT-SENSITIVE MATERIAL

[75] Inventor: Toshiyuki Marui, Tokyo, Japan

[73] Assignee: Konica Corporation, Japan

[21] Appl. No.: 221,758

[22] Filed: Apr. 1, 1994

[30] Foreign Application Priority Data

Apr. 8, 1993 [JP] Japan ..... 5-082051

[51] Int. Cl.[6] ..... G03C 1/76

[52] U.S. Cl. ..... 430/533; 430/534; 430/535

[58] Field of Search ..... 430/533, 534, 535

[56] References Cited

U.S. PATENT DOCUMENTS

H1,016 1/1992 Hatakeyama et al. ..... 430/534

FOREIGN PATENT DOCUMENTS 496346 7/1992 European Pat. Off. ..... G03C 1/795

OTHER PUBLICATIONS

Research Disclosure, vol. 189, No. 4; Jan. 10,1980, pp. 29–31 "Antistatic Compositions . . . Latex Binders".

*Primary Examiner*—Jack F. Brammer

*Attorney, Agent, or Firm*—Jordan B. Bierman

[57] ABSTRACT

A silver halide photographic light-sensitive material is disclosed. The light-sensitive material comprises a support having thereon a silver halide emulsion layer and optionally having another layer, and the emulsion layer or the other layer contains a kind of polymer latex comprising a polymer having a repeating unit derived from a monomer having a solubility in water at 25° C. of not higher than 0.025% by weight, and said support comprises polyethylene-2,6-naphthalate and has a thickness of from 70 μm to 120 μm.

5 Claims, No Drawings

SILVER HALIDE PHOTOGRAPHIC LIGHT-SENSITIVE MATERIAL

FIELD OF THE INVENTION

The present invention relates to a silver halide photographic light-sensitive material, and particularly relates to a silver halide photographic light-sensitive material in which the occurrence of development unevenness and roller marks caused by pressure fogging and pressure desensitization in the case of rapid processing in an automatic processing machine is prevented.

BACKGROUND OF THE INVENTION

Recently, following photographic technologies, enhancement of the sensitivity of silver halide photographic light-sensitive materials and enhancement of image quality are strongly demanded. In addition, following enhancement of consumption amount of light-sensitive materials, reduction of processing time has come to be demanded strongly.

For rapid processing, developability must be enhanced and drying load must be lightened. For example, rapid processing is attained by enhancing developability by processing a light-sensitive material at a high pH and a high temperature (30° to 40° C.) and reducing the amount of the binder in the light-sensitive material. However, there were some problem in the above-mentioned rapid processing. For example, due to the pressure of a conveyance roller, a so-called roller mark occurs, causing deterioration in image. In addition, in the course of slitting and packaging of a film and handling during diagnosis, pressure blackening occurs.

As means for improving the roller mark and the pressure blackening, methods to enhance the iodide content inside the structure of silver halide grains and to use latex have been reported. However, when the iodide content inside silver halide is enhanced, pressure desensitization is caused. In other words, the effect of this method is to take balance of contradictory performances of pressure blackening and pressure desensitization so that it is not a perfect solution of the problem. In addition, using of latex enhances the amount of binder. Accordingly, there were some shortcomings in terms of drying property and color residual property of the light-sensitive material in photographic processing.

SUMMARY OF THE INVENTION

An object of the present invention is to provide a silver halide photographic light-sensitive material with high sensitivity and high image quality wherein development unevenness and roller marks caused by pressure fogging or pressure desensitization that are caused by rapid processing in an automatic processing machine and no color residual occurs.

The light-sensitive material of the invention is a silver halide photographic light-sensitive material comprises a support having thereon a silver halide emulsion layer and optionally having another layer, in which the emulsion layer and/or another layer contains a kind of polymer latex comprising a polymer having a repeating unit derived from a monomer having a solubility in water at 25° C. of not higher than 0.025% by weight, and the support comprises polyethylene-2,6-naphthalate and has a thickness of from 70 μm to 120 μm.

The above monomer is preferably an acrylate compound, and more preferably an acrylate compound used in combination with a methacrylate compound.

The polymerization of the polymer latex of the invention is preferably carried out in the presence of a water-soluble polymer and/or a surfactant.

At least one of the monomers for use in forming the polymer latex of the invention has a solubility in water at 25° C. of not more than 0.025% by weight, and preferably not more than 0.015% by weight. Examples of such the ethylenic monomer include acrylates such as hexyl acrylate, 2-ethylhexyl acrylate, octyl acrylate, tert-octyl acrylate, nonyl acrylate, iso-nonyl acrylate, cyclohexyl acrylate, n-stearyl acrylate, lauryl acrylate and tridecyl acrylate; methacrylates such as hexyl methacrylate, 2-ethyl-hexyl methacrylate, octyl methacrylate, iso-octyl methacrylate, tert-octyl methacrylate, nonyl methacrylate, iso-nonyl methacrylate, cyclohexyl methacrylate, n-stearyl methacrylate, lauryl methacrylate and tridecyl methacrylate; and divinyl benzene.

The solubility in water at 25° C. of the monomer for use in forming the latex of the invention can be measured according to the method described in the 'Shin Jikken Kagaku Koza, Kihon Sosa 1, p.p. 223–250' ('New Experimental Chemistry Course: Basic Operations 1') (Maruzene Kagaku, 1975). When measured according to this method, the solubility in water at 25° C. of, e.g., 2-ethyl-hexyl acrylate is 0.01% by weight, 2-ethyl-hexyl methacrylate 0.01% by weight, cyclohexyl methacrylate 0.01% by weight, whereas in the case of usually used monomers, styrene 0.03% by weight, butyl acrylate 0.32% by weight and butyl methacrylate 0.03% by weight.

The polymer of the latex of the invention contains a repeating unit derived from the monomer having a solubility of not more than 0.025% in water at 25° C., in an amount of 10% to 100%, preferably 50% to 100%, by weight.

For the polymer latex used in the invention, copolymerization of the above monomer compound with different other monomer compounds may be carried out. Examples of copolymerizable ethylenic monomer compounds include acrylates, methacrylates, vinyl esters, olefins, styrenes, crotonic acid esters, iraconic acid diesters, maleic acid diesters, fumaric acid diesters, acrylamides, acryl compounds, vinyl ethers, vinyl ketones, vinyl heterocyclic compounds, glycidyl esters, unsaturated nitriles, polyfunctional monomers, and various unsaturated acids. From the above compounds one or two or more are selected to be used in combination as monomers for copolymerization.

To show these monomer compounds further in detail, examples of the acrylate include methyl acrylate, ethyl acrylate, n-propyl acrylate, isopropyl acrylate, n-butyl acrylate, iso-butyl acrylate, sec-butyl acrylate, tert-butyl acrylate, amyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, methoxybenzyl acrylate, furfuryl acrylate, tetrahydrofurfuryl acrylate, phenyl acrylate, 2-hydroxyethyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-iso-propoxy acrylate, 2-butoxyethyl acrylate, 2-(2-methoxyethoxy)ethyl acrylate, 2-(2-butoxyethoxy)ethyl acrylate, ω-methoxypolyethylene-glycol acrylate (addition molar number n=9), 1-bromo-2-methoxyethyl acrylate and 1,1-dichloro-2-ethoxyethyl acrylate.

Examples of the methacrylate include methyl methacrylate, ethyl methacrylate, n-propyl methacrylate, isopropyl methacrylate, amyl methacrylate, chlorobenzyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, 2-hydroxyethyl methacrylate, 4-hydroxybutyl methacrylate, triethylene-glycol monomethacrylate, dipropyleneglycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxyethoxy)ethyl methacrylate, ω-methoxypolyethylene-glycol methacrylate (addition molar number n=6), allyl methacrylate and dimethylaminoethylmethyl methacrylate chloride.

Examples of the vinyl ester include vinyl acetate, vinyl propionate, vinyl butyrate, vinyl isobutyrate, vinyl caproate, vinyl chloroacetate, vinylmethoxy acetate, vinylphenyl acetate, vinyl benzoate and vinyl salicylate.

Examples of the olefin include dicyclopentadiene, ethylene, propylene, 1-butene, 1-pentene, vinyl chloride, vinylidene chloride, isoprene, chloroprene, butadiene and 2,3-dimethylbutadiene.

Examples of the styrene include styrene, methylstyrene, ethylstyrene, chloromethy styrene, methoxystyrene, acetoxystyrene, chlorostyrene, bromostyrene, trifluorostyrene and vinylmethyl benzoate.

Examples of the crotonic acid ester include butyl crotonate and hexyl crotonate.

Examples of the iraconic acid diester include dimethyl itaconate, diethyl itaconate and dibutyl itaconate.

Examples of the maleic acid diester include diethyl maleate, dimethyl maleate and dibutyl maleate.

Examples of the fumaric acid diester include diethyl fumarate, dimethyl fumarate and dibutyl fumarate.

Examples of the acrylamide include acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacryiamide, phenylacrylamide, dimethylacrylamide, diethylacrylamide, β-cyanoethylacrylamide and N-(2-acetacetoxyethyl)acrylamide.

Examples of the methacrylamide include methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide and N-(2-acetacetoxyethyl)methacrylamide.

Examples of the allyl compound include allyl acetate, allyl caproate, allyl laurate and allyl benzoate.

Examples of the vinyl ether include methylvinyl ether, butylvinyl ether, hexylvinyl ether, methoxyethylvinyl ether and dimethylaminoethylvinyl ether.

Examples of the vinyl ketone include methylvinyl ketone, phenylvinyl ketone and methoxyethylvinyl ketone.

Examples of the vinylheterocyclic compound include vinylpyridine, N-vinylimidazole, N-vinyloxazolidone, N-vinyltriazole, N-vinylpyrrolidone.

Examples of the glycidyl ester include glycidyl acrylate and glycidyl methacrylate.

Examples of the unsaturated nitrile include acrylonitrile and methacrylonitrile. Those of the polyfunctional monomer include divinylbenzene, methylenebisacrylamide and ethyleneglycol dimethacrylate.

Further, acrylic acid, methacrylic acid, itaconic acid, maleic acid; monoalkyl itaconates such as monomethyl itaconate, monoethyl itaconate and monobutyl itaconate; monoalkyl maleates such as monomethyl maleate, monoethyl maleate and monobutyl maleate; citraconic acid, styrenesulfonic acid, vinylbenzylsulfonic acid, vinylsulfonic acid; acryloyloxyalkylsulonic acids such as acryloyloxyethylsulfonic acid and acryloyloxypropylsulfonic acid; methacryloyloxyalkylsulfonic acids such as methacryloyloxydimethylsulfonic acid, methacryloyloxyethylsulfonic acid and methacryloyloxypropylsulfonic acid; acrylamidoalkylsulfonic acids such as 2-acrylamido-2-methylethanesulfonic acid, 2-acrylamido-2-methylpropanesulfonic acid and 2-acrylamideo-2-methylbutanesulfonic acid; methacrylamidoalkylsulfonic acids such as 2-methacrylamido-2-methylethanesulfonic acid, 2-methacrylamido-2-methylpropanesulfonic acid and 2-methacrylamido-2-methylbutanesulfonic acid; acryloyloxyalkyl phosphates such as acryloyloxyethyl phosphate and 3-acryloyloxypropyl-2-phosphate; methacryloyloxyalkyl phosphates such as methacrylo-yloxyethyl phosphate and 3-metha-eryloyloxypropyl-2-phosphatei and naphthyl 3-allyloxy-2-hydroxypropanesulfonate having two hydrophilic groups. These acids may be used in the form of salts of alkali metals such as Na, K or of ammonium ions. As still further monomer compounds there may be used those crosslinking monomers as described in U.S. Pat. Nos. 3,459,790, 3,438,708, 3,554,987, 4,215,195 and 4,247,673, and JP O.P.I. No. 205735/1982. Examples of the crosslinking monomer include N-(2-acetacetoxyethyl)acrylamide and N-(2-(2-acetacetoxyethoxy)ethyl-)acrylamide.

The suitably usable among the above monomers compounds are acrylic acid esters, methacrylic acid esters, vinyl esters, styrenes and olefins.

Surfactants usable in the invention may be any of anionic surfactants, nonionic surfactants, cationic surfactants and amphoteric surfactants, and are preferably anionic and/or nonionic surfactants. As the anionic surfactants and/or nonionic surfactants, various compounds known to those skilled in the art may be used, but particularly, anionic surfactants are preferred. The following are useful examples of the surfactant for the invention.

The water-soluble high molecular material used for polymerization of the polymer latex of the invention includes synthetic water-soluble polymer materials and natural water-soluble polymer materials; either may be suitably used in the invention. Of these the synthetic water-soluble polymer materials include ones having a nonionic group, ones having an anionic group, ones having a cationic group, ones having both nonionic and anionic groups, ones having both nonionic and cationic groups, and ones having both anionic and cationic groups in their respective molecular structures. The nonionic group includes an ether group, an alkyleneoxide group, a hydroxy group, an amido group and an amino group. The anionic group includes a carboxyl group and its salts, a phospho group and its salts, a sulfo group and its salts. The cationic group includes a quaternary ammonium salt group and a tertiary amino group.

The natural water-soluble polymer materials also include ones having a nonionic group, ones having an anionic group, ones having cationic group, ones having both nonionic and anionic groups, ones having both nonionic and cationic groups and ones having both anionic and cationic groups in their respective molecular structures. Among these synthetic polymers and natural polymers, ones having an anionic group and having both anionic and nonionic groups are preferable.

In the invention, the water-soluble polymer is one having a solubility of preferably not less than 0.05 g, and more preferably not less than 0.1 g in 100 g of water at 20° C.

Examples of the natural water-soluble polymer includes those described in detail in the Collection of Technological Data for Water-Soluble Polymer Water-Dispersed Resins (Keiei-Kaihatsu Center), and preferably lignin, starch, pullulan, cellulose, dextran, dextrin, glycogen, alginic acid, gelatin, collagen, guar gum, gum arabic, laminatin, richenin, nigellone and their derivatives. As derivatives of these natural water-soluble polymers there may be preferably used those sulfonated, carboxylated, phosphated, sulfoalkylenated, carboxyalkylenated, alkyl-phosphated and salts thereof, and more preferably glucose, gelatin, dextran, cellulose and their derivatives.

The water-soluble polymer used in the invention accounts for preferably not less than 5% and not more than 30% by weight, and more preferably not less than 1% and not more than 15% by weight of the polymer of the latex.

The polymer latex used in the invention can be produced easily by any one of various methods, such as by redispersing a polymer that has been obtained in the emulsion polymerization, solution polymerization or block polymerization process.

The glass transition point Tg of the polymer to form the polymer latex used in the invention is preferably not more than 60° C., and more preferably not more than 40° C.

Synthetic methods of the polymer latex used in the invention are described in detail in U.S. Pat. Nos. 2,852,386, 2,853,457, 3,411,911, 3,411,912 and 4,197,127, Belgian Patent Nos. 688,882, 691,360 and 712,823, JP E.P. No. 5331/1970, JP O.P.I. Nos. 18540/1985, 130217/1976, 137831/1983 and 50240/1980.

The polymer latex of the invention has an average particle size of preferably 0.5 to 300 nm, and more preferably 30 to 250 nm.

Measurement of the particle size of the polymer latex of the invention may be made according to the electron-microscopic photography method, soap titration method, light-scattering method or centrifugal sedimentation method described in the 'Polymer Latex Chemistry' (Kobunshi-Kanko Kai, 1973), but of them the light-scattering method is suitably used. As a measuring instrument for the light-scattering method, a DLS700, manufactured by Ohtsuka Denshi Co. was used in the invention.

The average molecular weight of the polymer latex used in the invention, although not restricted, is preferably from 1,000 to 1,000,000, and more preferably 2,000 to 500,000 in weight average molecular weight.

As for the latex polymer content of the layer, it is preferably added in an amount of 30 to 200% by weight of the total amount of the binder contained in the photographic component layer or layers provided on the side of the support on which the layer containing the latex polymer. The polymer latex may be added to any photographic component layer regardless of whether it is an emulsion layer or another non-light-sensitive layer.

The coating amount of the latex polymer is preferably 0.2 g/m$^2$ is 2.0 g/m$^2$.

The polymer latex of the invention includes also functional polymers such as polymer couplers or polymer UV absorbing agents which are added in the form of latexes.

The following are synthesis examples of the polymer latex, but the invention is not limited thereto.

Synthesis example 1: Synthese of Lx-1

Three hundred and fifty milliliters of water were put in a 1,000 ml four-neck flask equipped with a stirrer, a thermometer, a dropping funnel, a nitrogen conduction pipe and a flux condenser with its inside being deoxidized by conducting nitrogen gas thereinto, and was heated until the inside temperature reached 80° C., and to this were added 4.5 g of a dispersing agent Sf-1, 0.45 g of ammonium persulfate as a polymerization initiator, and then added dropwise 90 g of ethylhexyl acrylate for about an hour through the dropping funnel. After completion of the dropwise addition, the reaction was still continued over a period of 5 hours, and then the unreacted monomer moiety was removed by steam distillation. After ward, the product was cooled and then its pH was adjusted to 6 with ammonia water, whereby a polymer latex having an average particle size of 150 nm was obtained.

Synthesis example 2: Synthesis of Lx-2

Three hundred and fifty milliliters of water were put in a 1,000 ml four-neck flask equipped with a stirrer, a thermometer, a dropping funnel, a nitrogen conduction tube and a flux condenser with its inside being deoxidized by conducting nitrogen gas thereinto and was heated until the inside temperature reached 80° C., and to this were added 4.5 g of a dispersing agent P-12 for the invention, 0.45 g of ammonium persulfate as a polymerization initiator, and then dropwise added 90 g of ethylhexyl acrylate for about an hour through the dropping funnel. After completion of the dropwise addition, the reaction was still continued over a period of 4 hours, the unreacted monomer moiety was removed by steam distillation, afterward, the product was cooled and its pH was adjusted to 6 with ammonia water, whereby an objective polymer latex having an average particle size of 200 nm was obtained.

Synthesis example 3: Synthesis of Lx-10

Two hundred milliliters of dioxane were put in a 500 ml three-neck flask with its inside being deoxidized by conducting nitrogen gas thereinto, and later to this were added 15 g of isononyl acrylate, 35 g of cyclohexyl acrylate and then 1.2 g of dimethyl azobisisobutyrate as a polymerization initiator to have their reaction continue for 6 hours at 60° C. After completion of the reaction, the reaction liquid was poured in 3 liters of distilled water with vigorously stirring, whereby white crystals were obtained.

The white crystals were filtered, dried, and then dissolved in 100 ml of ethyl acetate. This solution was added with vigorously stirring to 500 ml of distilled water containing 2 g of Sf-2, and then the ethyl acetate was removed, whereby an objective polymer latex having an average particle size of 180 nm was obtained.

Synthesis example 4: Synthesis of comparative Latex L

To a solution of 0.05 kg of KMDS (sodium dextran sulfate, produced by Meito Ind. Co.) and 0.05 kg of ammonium persulfate dissolved in 40 liters of water, with stirring at 81° C. under a nitrogen atmospheric condition, was added spending an hour a mixture of 4.51 kg of n-butyl acrylate, 5.49 kg of styrene and 0.1 kg of acrylic acid, and after that 0.005 kg of ammonium persulfate was added, and further after 1.5-hour stirring, the latex product was cooled and its pH was adjusted to 6 with ammonia water.

The obtained latex was filtered by using a GF/D filter, manufactured by Whotman Co., and water was added to make the whole liquid 50.5 kg, whereby a monodisperse Latex (L) having an average particle size of 250 nm was obtained.

Examples of the polymer latex according to the invention are listed below, wherein each suffixed number represents the content percentage of each monomer unit.

| | | Surfactant |
|---|---|---|
| Lx-1 | $\leftarrow CH_2-CH\rightarrow_{100}$ (0.010) $COOCH_2CHC_4H_9$ ($C_2H_5$) | Sf-1 |
| Lx-2 | $\leftarrow CH_2-CH\rightarrow_{100}$ (0.010) $COOCH_2CHC_4H_9$ ($C_2H_5$) | P-3 |
| Lx-3 | $\leftarrow CH_2-CH\rightarrow_{100}$ (0.004) $COOC_9H_{19}$(iso) | P-2 |
| Lx-4 | $\leftarrow CH_2-CH\rightarrow_{100}$ (0.010) COOCH, $CH_2-CH_2$, $CH_2$, $CH_2-CH_2$ | P-1 |
| Lx-6 | $\leftarrow CH_2-CH\rightarrow_{55}$ (0.004) $COOC_9H_9$(iso); $\leftarrow CH_2-CH\rightarrow_{45}$ (0.030) | Sf-2 |
| Lx-7 | $CH_3$, $\leftarrow CH_2-C\rightarrow_{100}$ (0.003) $COOCH_2CHC_4H_9$ ($C_2H_5$) | Dextran-sulfate |
| Lx-8 | $CH_3$, $\leftarrow CH_2-C\rightarrow_{100}$ (0.003) $COOCH_2CHC_4H_9$ ($C_2H_5$) | P-4 |
| Lx-10 | $CH_3$, $\leftarrow CH_2-C\rightarrow_{30}$ (0.003) $COOC_9H_9$(iso); $\leftarrow CH_2-CH\rightarrow_{70}$ (0.010) COOCH, $CH_2-CH_2$, $CH_2$, $CH_2-CH_2$ | Sf-2 |

-continued

| | | Surfactant |
|---|---|---|
| Lx-11 | $-(CH_2-C(CH_3))_{100}-$ COOC$_9$H$_{19}$(n) (0.003) | Sf-1 |
| Lx-12 | $-(CH_2-CH)_{50}-$ COOC$_8$H$_{17}$(n) (0.010) $-(CH_2-C(CH_3))_{50}-$ COOCH$_3$ (1.72) | Sf-3 |
| Lx-13 | $-(CH_2-CH)_{50}-$ COOC$_8$H$_{17}$(n) (0.010) $-(CH_2-C(CH_3))_{40}-$ COOCH$_3$ (1.720) $-(CH_2-C(CH_3))_{10}-$ COOCH$_2$CH—CH$_2$ (O) (2.500) | Sf-4 |
| Lx-14 | $-(CH_2-CH)_{50}-$ COOC$_8$H$_{17}$ (0.010) $-(CH_2-CH)_{50}-$ (C$_6$H$_5$) (0.030) | Sf-3 |
| Lx-15 | $-(CH_2-CH)_{40}-$ COOC$_8$H$_{17}$ (0.010) $-(CH_2-CH)_{50}-$ COOCH (CH$_2$—CH$_2$)$_3$ (0.010) $-(CH_2-C(CH_3))_{10}-$ COOCH$_2$CH—CH$_2$ (O) (2.50) | P-2 |
| Lx-16 | $-(CH_2-CH)_{40}-$ COOC$_9$H$_9$(iso) (0.003) $-(CH_2-CH)_{50}-$ (C$_6$H$_5$) (0.030) $-(CH_2-CH)_{10}-$ COOCH (CH$_2$—CH$_2$)$_3$ (0.010) | P-3 |
| Lx-17 | $-(CH_2-CH)_{40}-$ COOCH$_2$CHC$_4$H$_9$ (C$_2$H$_5$) (0.01) $-(CH_2-CH)_{40}-$ COOCH (CH$_2$—CH$_2$)$_3$ (0.010) $-(CH_2-C(CH_3))_{20}-$ COOCH$_2$CH—CH$_2$ (O) (2.50) | Sf-1 |
| Lx-18 | $-(CH_2-CH)_{60}-$ COOC$_9$H$_{19}$ (0.003) $-(CH_2-C(CH_3))_{30}-$ COOCH (CH$_2$—CH$_2$)$_3$ (0.004) $-(CH_2-C(CH_3))_{10}-$ COOCH$_2$CH—CH$_2$ (O) (2.50) | P-3 |
| Lx-19 | $-(CH_2-CH)_{20}-$ COOC$_9$H$_{19}$(iso) (0.004) $-(CH_2-CH)_{50}-$ COOCH (CH$_2$—CH$_2$)$_3$ (0.010) $-(CH_2-C(CH_3))_{30}-$ COOCH (CH$_2$—CH$_2$)$_3$ (0.004) | P-2 Sf-3 |

-continued

| | | Surfactant |
|---|---|---|
| Lx-20 | 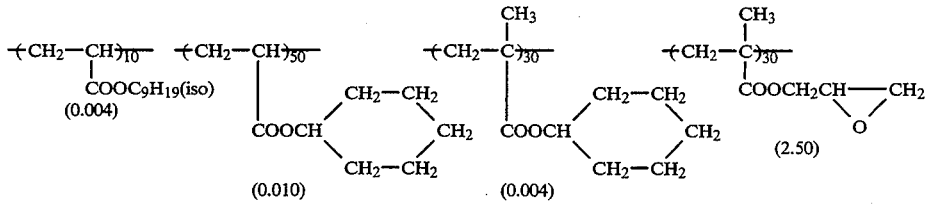 | P-2<br>Sf-3 |
| Lx-21 | 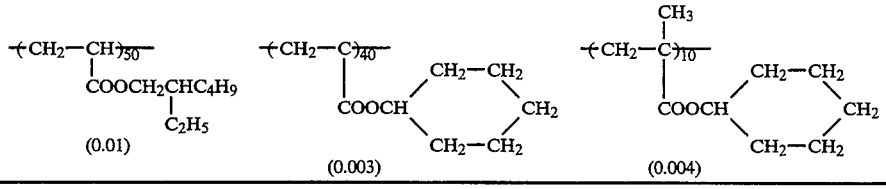 | Sf-3 |

Sf-1 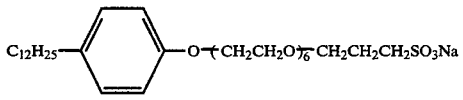

Sf-2 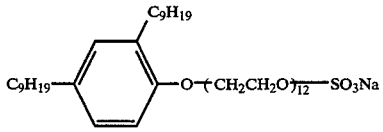

Sf-3 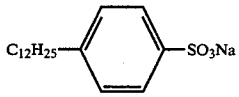

Sf-4 $C_{12}H_{25}OSO_3Na$

P1 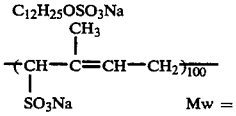

Mw = 5000

P2 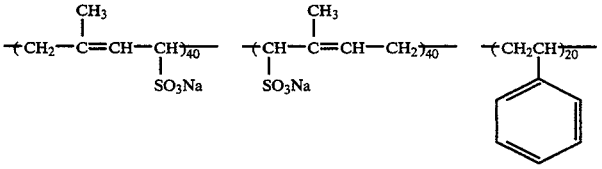

Mw = 40000

P-3 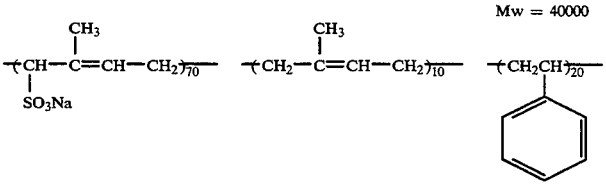

Mw = 40000

P-4 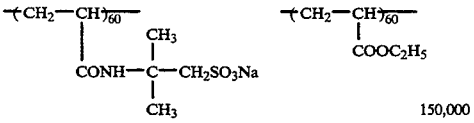

150,000

Polyethylene-2,6-naphthalate, the support for the silver halide photographic light-sensitive material of the present invention, is described below.

The polyethylene-2,6-naphthalate mentioned herein is a polymer substantially consisting of ethylene-2,6-naphthalate units, but may be an ethylene-2,6-naphthalate polymer modified with a small amount, e.g., not more than 10 mol%, preferably not more tan 5 mol% of a third component.

Polyethylene-2,6-naphthalate is usually produced by condensing naphthalene-2,6-dicarboxylic acid or a functional derivative thereof such as methyl naphthalene-2,6-dicarboxylate, and ethylene glycol under appropriate reaction conditions in the presence of a catalyst. The third component is exemplified by dicarboxylic acids such as adipic acid, oxalic acid, isophthalic acid, terephthalic acid, naphthalene-2,7-dicarboxylic acid and diphenyl ether dicarboxylic acid or lower alkyl esters thereof, dicarboxylic acids such as p-oxybenzoic acid and p-ethoxybenzoic acid or lower alkyl esters thereof, dihydric alcohols such as propylene glycol, trimethylene glycol, tetramethylene glycol, pentamethylene glycol, hexamethylene glycol and diethylene glycol, and polyalkylene glycols such as polyethylene glycol and polytetramethylene glycol.

This polymerization may be carried out in the presence of lubricants such as titanium dioxide, stabilizers such as phosphoric acid, phosphatic acid and esters thereof, antioxidants such as hindered phenol, polymerization regulators and plasticizers.

Preferably, the polyethylene naphthalate for the present invention has a intrinsic viscosity number of not lower than 0.4, preferably 0.40 to 0.65. The intrinsic viscosity number can be measured by a Ubbelohdes viscosimeter. The degree of crystallization is preferably not lower than 35% and not higher than 60%. The crystallinity degree is measured by a density-gradient-column method and defined according to the following equation:

$$\text{Crystallinity degree} = (\rho_{(100)} - \rho / \rho_{(100)} - \rho_{(O)}) \times 100\%$$

in the above, $\rho$ = Density of the material measured $\rho_{(100)}$ = Density of the material in a perfect crystal form $\rho_{(0)}$ = Density of the material in an amorphous form The support of the invention of polyethylene-2,6-naphthalate film can be prepared by a known method. The film may be stretched lengthwise and widthwise simultaneously or successively, and the stretching may be performed by 2 steps or more to each direction of length and width.

In the present invention, the thickness of the support comprised of polyethylene-2,6-naphthalate is 70 to 120 μm. The formation of scrach marks and roller marks in the light-sensitive material using tabular silver halide grains with a high aspect ratio of 2 or more are prevented by the use of the above polyethylene-2,6-naphthalate film having a thickness within the above range.

Since the commercial value of the polyethylene-2,6-naphthalate film of the present invention decreases when dust adheres thereto upon use, its surface resistivity is preferably not higher than 1014 Ω•cm. To obtain such a film, various methods are used as appropriate, including the method in which an antistatic agent is coated, the method in which a thin layer of a metal or metal compound is formed on the film surface, the method in which an antistatic agent is added at polymerization of the starting materials for polyester, and the method in which the starting materials for polyester and an antistatic agent are mixed at film preparation. Polyethylene-2,6-naphthalene as obtained by polymerization condensation of the starting materials sodium alkylbenzenesulfonate and polyalkylene glycol may also be used.

In the monomers to be used to produce polyethylene-2,6-naphthalene used in the present invention, dimethyl naphthalene-2,6-dicarbonate account 40 mol% or more, preferably 60 mol% or more, further preferable 80 mol% or more.

The support surface may be subjected to subbing, corona discharge, ultraviolet irradiation, etc. to facilitate coating layer adhesion.

The method producing the support used in the invention is described below.

Preparation of support

After an ester exchanging reaction catalyst was added to 100 parts of dimethyl naphthalene-2,6-dicarboxylate and 60 parts of ethylene glycol, 1.2 parts of sodium dodecylbenzenesulfonate, 0.8 parts of polyethylene glycol (Mw = 8000) and 0.01 part of thyroid were added, followed by polymerization condensation. The resulting polyethylene-2,6-naphthalate was fused and extruded as a film and stretched to 4.2 fold at 170° C. and then transversely 4.2 fold stretched at 150° C.

Te stretched film was fixed at 255° C. for 10 seconds. a 100 μm film was thus obtained.

Supports of 70 μm, 120 μm and 180 μm thickness were prepared at different degrees of stretching.

Subbing

Each support was subbed in the same manner as for sample No. 9 in Example 1 of Japanese Patent O.P.I. Publication No. 104913/1977.

The silver halide emulsion usable in the light-sensitive material of the invention may be a silver bromide emulsion, silver iodobromide emulsion and a silver chloroiodobromide emulsion containing a little amount of silver chloride. Silver halide grains may have any crystal form including cubic, octahedral and tetradecahedral single crystal and polycrystals with various shapes.

The silver halide emulsion usable in the light-sensitive material of the invention can be prepared by known methods such as those described in, for example, Research Disclosure No. 17643 (December 1978), and Research Disclosure No. 18716, p.648 (November 1979).

Further, the silver halide emulsion may be used in the light-sensitive material can be prepared according to the methods described in, for example, T. H. James, The Theory of Photographic Process, 4th edition, Macmillan (1977), p.p. 38–104; G. F. Duffin, Photographic Emulsion Chemistry, Focal Press (1966); P. Glafkides, Chimie et Physique Photographique, Paul Montel (1967); and V. L. Zelikman et al., Making and Coating Photographic Emulsion, Forcal Press (1946).

It is a preferable embodiment of the light-sensitive material of the invention in which a monodisperse emulsion comprising silver halide grains containing silver iodide locally distributed in each of the grains. The term of "monodisperse emulsion" means a silver halide emulsion in which at least 59% of the whole grains are within ±40%, preferably ±30%, of average grain size in the grain number or weight, when the average grain size is measured in an ordinary method.

Concerning the size distribution of silver halide grains, the emulsion may be either a monodisperse emulsion having a narrow size distribution one having or polydisperse emulsion having a wide size distribution. The silver halide grains may have a structure in which the halide composition of the inner portion and that of outer portion are different from each other, for example, the emulsion may be a monodisperse emulsion comprising silver halide grains each having clear double-layer formed by covering a core having high iodide content by a shell layer having a low iodide content.

Preparation methods of the monodisperse emulsion are well known and are described, for example, in J. Photo. Sci., 12, 242–251 (1963), JP O.P.I. Publication Nos. 36890/1973, 16364/1977, 142329/1980, 49938/1983, BP 1,413,748, U.S. Pat. No. 3,574,628 and U.S. Pat. No. 3,655,394. The silver halide emulsion to be used in the light-sensitive material of the invention may be prepared by a method in which a seed crystal used as a crystal growing nucleus and the seed grain is grown by supplying silver ions and halide ions.

The preparation method of the above core/shell type emulsion are well known and J. Photo. Sci., 24, 198 (1976), U.S. Pat. Nos. 2,592.250, 3.505.068, 4,210,450, 4,444,877 and JP O.P.I. 143331/1985 can be referred.

The emulsion to be used in the light-sensitive material of the invention may be an emulsion comprising tabular grains having an aspect ration, a ratio of diameter/-thickness of the grain, of not lower than 3. For example, BP 2,112,157, and U.S. Pat. No. 4,414,310 and U.S. Pat. No. 4.434.226 disclose that such tabular grains are advantageous for improvement in the optical sensitization efficiency and the graininess and granularity of image. The tabular grain emulsion can be prepared by the methods described in these publications.

The emulsion may either be a surface latent image type, in which latent image is formed on the surface of the grain, or an internal image type in which latent image is formed at internal portion of the grain.

A metal compound such as a cadmium salt, a lead salt, a thallium salt, a salt or complex of iridium, a salt or complex of rhodium and a salt or complex of iron may be added to the emulsion in the course of formation or physical ripening of silver halide grains.

To remove soluble salts, the emulsion may be washed by noodle washing or flocculation precipitation method. Preferred washing methods includes a method using a sulfo group-containing aromatic hydrocarbon aldehyde resin described in JP O.P.I. Publication 16086/1960 and a method using polymeric flocculating agents G-3 and G-8 described in JP O.P.I. Publication 158644/1988.

The silver halide emulsion relating to the present invention may incorporate various photographic additives added before or after physical ripening or chemical ripening. Such additives include those described in Research Disclosure Nos. 17643 (December 1978), 18716 (November 1979) and 308119 (December 1989) (hereinafter referred to as RD17643, RDt8716 and RD308119, respectively). The following table shows where the additives are described.

| | RD17643 | | RD18716 | RD308119 | |
|---|---|---|---|---|---|
| Additive | Page | Cate. | Page | Page | Cate. |
| Chemical sensitizer | 23 | III | 648 upper right | 996 | III |
| Sensitizing dye | 23 | IV | 648–649 | 996–998 | IV |
| Desensitizing dye | 23 | IV | | 998 | B |
| Dye | 25–26 | VIII | 649–650 | 1003 | VIII |
| Developing accelerator | 29 | XXI | 648 upper right | | |
| Antifogging agent/stabilizer | 24 | IV | 649 upper right | 1006–1007 | VI |
| Brightening agent | 24 | V | | 998 | V |
| Hardener | 26 | X | 651 left | 1004–1005 | X |
| Surfactant | 26–27 | XI | 650 right | 1005–1006 | XI |
| Antistatic agent | 27 | XII | 650 right | 1006–1007 | XIII |
| Plasticizer | 27 | XII | 650 right | 1006 | XII |
| Lubricant | 27 | XII | | | |
| Matting agent | 28 | XVI | 650 right | 1008–1009 | XVI |
| Binder | 26 | XXII | | 1003–1004 | IX |
| Support | 28 | XVII | | 1009 | XVII |

As the support used in a light-sensitive material relating to the invention, for example, ones described on page 28 of RD-17643 and page 1009 of RD-308119 may be used. Preferable support is a plastic film, to the surface of which a subbing layer coating, corona discharge treatment or ultraviolet irradiation may be applied to enhance the adhesivness of the surface to a coating layer provided on the surface.

The light-sensitive material of the invention may be processed by processing solutions, for example, described in the above-mentioned RD-17643, XX—XXI, p. 29–30, and RD-308119, XX–XXI, p. 1011–1012. The processing may be a black and white processing to form an silver image. The processing is carried out normally at a temperature between 18° C. to 50° C.

In the black and white processing, dihydroxybenzenes such as hydroquinone and 3-pyrazolidones such as 1-phenyl-3-pyrazolidone may be used solely or in combination as developing agent. The developer may further contains known additives including a preservative, an alkaline agent, a pH buffer, an antifoggant, a hardener, a development accelerator, a surfactant, a defoaming agent, a toning agent, a softener, a dissolving aid and a thickner.

A fixing agent such as thiosulfate or thiocyanate is used in the fixer. The fixer may contain a hardener including water-soluble amuminum salts such as aluminum sulfate and alum.

EXAMPLES

The invention will be explained in detail in the followings with examples.

Preparation of Emulsions A to C

<Preparation of seed emulsion>

While maintaining a temperature of 60° C., a pAg of 8 and a pH of 2.0, monodispersed cubic grains of silver iodobromide having an average grain size of 0.3 μm and a silver iodide content of 2 mol% were prepared by the double-jet method. The resulting reaction mixture was desalinized at 40° C., using an aqueous solution of Demol-N (produced by Kao Atlas) and an aqueous solution of magnesium sulfate, after which the flocculant was re-dispersed in an aqueous gelatin solution, to yield a seed emulsion.

<Growing the seed grains>

The eed grains of the seed emulsion were grown as follows: First, the seed emulsion was dispersed in an aqueous gelatin solution being kept at 40° C., and pH thereof was adjusted to 7.9. An aqueous solution of ammoniacal silver nitrate and an aqueous solution of potassium bromide and potassium iodide were then added to the dispersion by the double-jet method, while maintaining a pAg of 7.3 and a pH of 9.7, to form a layer containing 35 mol% silver iodide on the seed grain. Next, another aqueous solution of ammoniacal silver nitrate and an aqueous solution of potassium bromide were added by the double-jet method. Until 95% of the desired grain size was reached, the pAg was kept at 9.0, the pH being varied continuously over the range from 9.0 to 8.0.

The pAg was then changed to 11.0, and while keeping the pH at 8.0, grains were grown until the desired grain size was obtained. Subsequently, acetic acid was added to obtain a pH of 6.0, and the silver potential was adjusted to +25 mV using an aqueous solution of potassium bromide. Then the anhydride of 5,5'-dichloro-9-ethyl-3,3'-di-(3-sulfopropyl)-oxacarbocyanine sodium salt (dye A) and the anhydride of 5,5'-di-(butoxycarbonyl)-1,1'-diethyl-3,3'-di-(4-sulfobutyl)-benzimidazolocarbocyanine sodium salt (dye B), at 300 mg and 15 mg per mol of silver halide, respectively, were added as spectral sensitizing dyes.

Next, to remove the excess salts by precipitation, the mixture was desalted with the above aqueous solution of Demol-N and aqueous solution of magnesium sulfate, and then stirred and re-dispersed in an aqueous solution containing 92.2 g of ossein gelatin.

Monodispersed silver iodobromide emulsions A, B and C, comprising tetradecahedral grains with round apexes having an average silver iodide content of 2.0 mol%, were thus prepared, which had average grain sizes of 0.40 μm, 0.65 μm and 1.00 μm and variation coefficients (δ/r) of 0.17, 0.16 and 0.16, respectively.

Preparation of emulsions D through F

<Preparation of spherical seed emulsion>

A monodispersed spherical seed emulsion was prepared by the method of Japanese Patent O.P.I. Publication No. 6643/1986.

| | |
|---|---|
| Solution A | |
| Ossein gelatin | 150 g |
| Potassium bromide | 53.1 g |
| Potassium iodide | 24 g |
| Water was added to make a total quantity of | 7.2 l. |
| Solution B | |
| Silver nitrate | 15000 g |
| Water was added to make a total quantity of | 6 l. |
| Solution C | |
| Potassium bromide | 1327 g |
| 1-phenyl-5-mercaptotetrazole (dissolved in methanol) | 1.2 g |
| Water was added to make a total quantity of | 3 l. |
| Solution D | |
| Aqueous ammonia (28%) | 705 ml |

To solution A being vigorously stirred at 40° C., solutions B and C were added by the double jet method over a period of 30 seconds, whereby nuclei were formed. During this operation, pBr was kept between 1.09 and 1.15.

One minutes and 30 seconds later solution D was added over a period of 20 seconds, followed by ripening for 5 minutes at a KBr concentration of 0.071 mol/1 and an ammonia concentration of 0.63 mol/l.

Then the seed emulsion was adjusted to pH 6.0 and immediately desalinized and washed. Electron microscopy identified this seed emulsion as a monodispersed spherical emulsion having an average grain size of 0.26 μm and a distribution width of 18%.

Preparation of grown emulsion

The resulting spherical seed emulsion, at 0.14 mol per mol of the silver in the desired grown emulsion, was dissolved and dispersed in a 65° C. aqueous solution of gelatin containing polypropyleneoxy-polyethyleneoxy-disuccinate sodium salt (process A), after which dimethylamineborane was added to a concentration of $1\times10^{-5}$ mol per mol of the silver in the finished silver halide emulsion. Subsequently, a silver nitrate solution, adjusted to a final average silver iodide content of 0.50 mol%, and a halide solution of potassium bromide and potassium iodide were added by the controlled double jet method over a period of 43 minutes, while maintaining a pH of 2.0, a pAg of 8.0 and a temperature of 65° C.

In this operation, the silver potential was adjusted to +25 mV using an aqueous solution of potassium bromide. Then the above-mentioned dyes A and B, at 300 mg and 15 mg per mol of silver halide, respectively, were added as spectral sensitizing dyes.

Next, to remove the excess salts by precipitation, the mixture was desalinized with the above aqueous solution of Demol-N and aqueous solution of magnesium sulfate, and then stirred and re-dispersed in an aqueous solution containing 92.2 g of ossein gelatin. Emulsion D, comprising tabular silver iodobromide grains having an average grain size of 1.22 μm, an average thickness of 0.29 μm and an aspect ratio of 4.2, was thus obtained. Emulsions E through G, having aspect ratios of 2.5, 7.2 and 12, respectively, were obtained in the same manner as above, except that grain growing pAg and pH were changed as appropriate.

To each of the obtained emulsions A through G, the above-mentioned spectral sensitizing dyes A and B, at 300 mg and 15 mg per mol of silver halide, respectively, were added at 55° C.

Ten minutes later, appropriate amounts of chloroauric acid, sodium thiosulfate and ammonium thiocyanate were added for chemical sensitization. Fifteen minutes before completion of ripening, 0.8 mmol of fine silver iodide grains (average grain size 0.05 μm) per mol of silver halide was added. Subsequently, 4-hydroxy-6-methyl-1,3,3*a*,7-tetrazaindene was added at $3\times10^{-2}$ mol per mol of silver halide, and this mixture was dispersed in an aqueous solution of 70 g of gelatin.

To each emulsion, the following additives were added to yield an emulsion layer coating solution. At the same time the following protective layer coating solution was prepared. Each of these emulsions and protective layers were simultaneously coated on both faces of the support using two slide hopper type coaters at a speed of 80 m per minute so that the amount of silver coated would be 1.9 g/m$^2$ per face, the amount of gelatin coated would be 2.0 g/m$^2$ for the emulsion layers, and the amount of gelatin coated would be 1.1 g/m$^2$ for the protective layer, followed by drying for 2 minutes 20 seconds, to yield a sample. The sample was adjusted to 190% swelling rate (determined by the measuring method described in Japanese Patent O.P.I. Publication No. 206750/1988) by changing the amount of hardener.

Additives used in the emulsion are as followings. Added amounts are given in terms of the amount per mol of silver halide.

| | |
|---|---|
| 1,1'-dimethylol-1-bromo-1-nitromethane | 70 mg |
| t-butylcatechol | 400 mg |
| Polyvinylpyrrolidone (Mw: 10,000) | 1.0 g |
| Styrene-maleic anhydride copolymer | 2.5 g |
| Nitrophenyl-triphenyl-phosphonium chloride | 50 mg |
| Ammonium 1,3-dihydroxybenzene-4-sulfonate | 2 g |
| Sodium 2-mercaptobenzimidazole-5-sulfonate | 1.5 g |

-continued

| | |
|---|---|
| 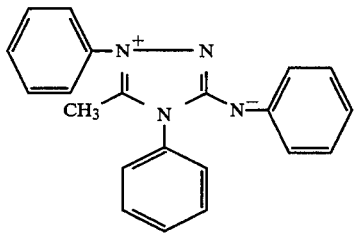 | 150 mg |
| 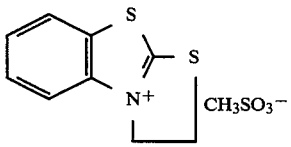 | 30 mg |
| $C_4H_9OCH_2CH(OH)CH_2N(CH_2COOH)_2$ | 1 g |
| 1-phenyl-5-mercaptotetrazole | 15 mg |

Protective layer solution

The following protective layer solution was prepared. The amount of the additives are given in terms of the amount per liter of the solution.

| | |
|---|---|
| Sodium i-amyl-n-decylsulfosuccinate | 1 g |
| Plymethylmetacrylate (Matting agent having an average grain size of 3.5 μm) | 1.1 g |
| Silicon dioxide (Matting agent having an average grain size of 3.5 μm) | 0.5 g |
| Ludox MA (colloidal silica, du Pont) | 30 g |
| $(CH_2{=}CHSO_2CH_2)_{20}$ (Hardener) | 500 mg |
| $C_4F_9SO_3K$ | 2 mg |
| $C_{12}H_{25}CONH(CH_2CH_2O)_5H$ | 2.0 g |
| 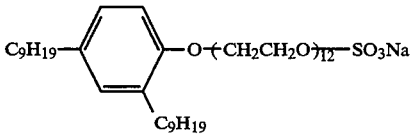 | 12 mg |
| 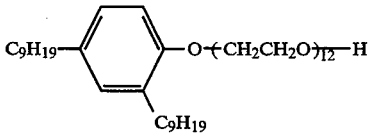 | 2 mg |
| 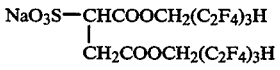 | 5 mg |
| 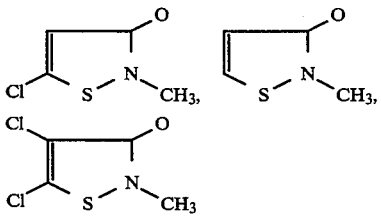 (50:46:4) | 0.73 mg |
| $F_{19}C_9O(CH_2CH_2O)_{10}CH_2CH_2OH$ | 3 mg |

-continued

| | |
|---|---|
| 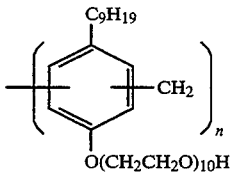 (mixture of ones having n = 2–5) | 15 mg |

The samples were processed by an autoprocessor SRX-502, produced by Konica, with 45 second processing mode. Developer XD-SR and Fixer XF-SR, products of Konica, were used in the processing. Development and fixing were carried out at 35° C. and 33° C., respectively.

Using the resulting samples, scratch durability, roller marks and color residual property were evaluated by the following method. The results thereof are shown in Table 1.

[Evaluation on anti-scratch property]

On a sample whose temperature and humidity were respectively regulated at 23 ° C. and 48%, a scrubbing brush made of nylon was located. On the scrubbing brush, a weight with 200 g was put on. With a speed of 10 cm/min., the sample was scratch with the above-mentioned scrubbing brush. Following that, the sample was subjected to photographic processing, and the degree of scratch was judged visually.

Evaluation standard

A: There are no scratches.

B: Slight and faint blackened portions are observed if viewed carefully. However, there is little scratch.

C: Slight and faint blackened portions are observed. However, there is no practical problem.

D: Blackened portions are observed clearly so that they are problematic.

E: There are many blackened lines so that it is impossible to put into practical use.

[Roller mark]

Films exposed to light so that the density would be 1.0 were subjected to photographic processing. The films were evaluated visually.

A: There are no pressure dot marks.

B: There are faint dot marks at the edge of the film if viewed carefully. However, there is no practical problem.

C: There are faint dot marks at the center of the film. However, there is no practical problem.

D: There are dense dot marks at the edge of the film. They are practically problematic.

E: There are dense dot marks at the center portion and at the edge portion. This film cannot be put into practical use.

[Color residual property]

Unexposed sample films were subjected to photographic processing. The films were evaluated visually.

A: No color residual occurred.

B: The edge portion of film was slightly reddish if viewed carefully. However, there are practically no problems.

C: There are reddish lines at the edge of film, if viewed carefully. However, there are practically no problems.

D: There are reddish lines at the center of the film. They are practically problematic.

E: There are dense reddish lines at the center portion. This film cannot be put into practical use.

Tables 1 and 2 show the results thereof.

TABLE 1

| Sample No. | Emulsion | Gel amount in emulsion layer [g/m²] | Gel amount in protective layer [g/m²] | Polymer Latex No. | Polymer Latex Added portion | Polymer Latex Added amount [g/m²] | Support Material | Support Thickness [μm] | Scratch | Roller mark | Color remaining | Note |
|---|---|---|---|---|---|---|---|---|---|---|---|---|
| 1 | H | 2.00 | 1.10 | L | Emulsion layer | 0.40 | PET | 180 | B | C | C | Comp. |
| 2 | H | 2.00 | 1.10 | Lx-1 | Emulsion layer | 0.40 | PET | 180 | B | C | C | Comp. |
| 3 | H | 2.00 | 1.10 | Lx-1 | Emulsion layer | 0.40 | PET | 100 | C | D | C | Comp. |
| 4 | H | 2.00 | 1.10 | Lx-1 | Emulsion layer | 0.40 | PEN | 120 | A | B | B | Inv. |
| 5 | H | 2.00 | 1.10 | Lx-1 | Emulsion layer | 0.40 | PEN | 100 | A | B | B | Inv. |
| 6 | H | 2.00 | 1.10 | Lx-1 | Emulsion layer | 0.40 | PEN | 70 | A | B | B | Inv. |
| 7 | I | 2.00 | 1.10 | L | Emulsion layer | 0.40 | PET | 100 | D | D | D | Comp. |
| 8 | I | 2.00 | 1.10 | Lx-1 | Emulsion layer | 0.40 | PET | 100 | C | D | D | Comp. |
| 9 | I | 2.00 | 1.10 | Lx-1 | Emulsion layer | 0.40 | PEN | 100 | B | B | B | Inv. |
| 10 | I | 1.50 | 1.10 | L | Emulsion layer | 1.0 | PEN | 100 | C | C | E | Comp. |
| 11 | I | 1.50 | 1.10 | Lx-1 | Emulsion layer | 1.0 | PEN | 100 | A | A | B | Inv. |
| 12 | I | 2.00 | 1.10 | Lx-2 | Emulsion layer | 0.40 | PEN | 100 | B | B | B | Inv. |
| 13 | I | 1.50 | 1.10 | Lx-2 | Emulsion layer | 1.00 | PEN | 100 | A | A | B | Inv. |
| 14 | I | 2.00 | 1.10 | Lx-10 | Emulsion layer | 0.40 | PEN | 100 | B | B | B | Inv. |
| 15 | I | 1.50 | 1.10 | Lx-10 | Emulsion layer | 1.00 | PEN | 100 | A | A | B | Inv. |
| 16 | I | 2.00 | 0.60 | Lx-10 | Protective layer | 1.00 | PEN | 100 | B | A | B | Inv. |
| 17 | I | 2.00 | 0.60 | Lx-10 | Protective layer | 1.00 | PEN | 70 | B | A | B | Inv. |
| 18 | I | 2.00 | 0.60 | Lx-10 | Protective layer | 1.00 | PEN | 120 | A | A | B | Inv. |
| 19 | D | 2.00 | 1.10 | L | Emulsion layer | 0.40 | PET | 180 | D | C | D | Comp. |
| 20 | D | 2.00 | 1.10 | Lx-2 | Emulsion layer | 0.40 | PET | 180 | C | C | D | Comp. |

TABLE 2

| Sample No. | Emulsion | Gel amount in emulsion layer [g/m²] | Gel amount in protective layer [g/m²] | Polymer Latex No. | Polymer Latex Added portion | Polymer Latex Added amount [g/m²] | Support Material | Support Thickness [μm] | Scratch | Roller mark | Color remaining | Note |
|---|---|---|---|---|---|---|---|---|---|---|---|---|
| 21 | D | 2.00 | 1.10 | Lx-2 | Emulsion layer | 0.40 | PEN | 180 | C | C | D | Comp. |
| 22 | D | 2.00 | 1.10 | Lx-2 | Emulsion layer | 0.40 | PEN | 120 | B | B | B | Inv. |
| 23 | D | 2.00 | 1.10 | Lx-2 | Emulsion layer | 0.40 | PEN | 100 | B | B | B | Inv. |
| 24 | D | 2.00 | 1.10 | Lx-2 | Emulsion layer | 0.40 | PEN | 70 | B | B | B | Inv. |
| 25 | D | 2.00 | 1.10 | Lx-10 | Emulsion layer | 0.40 | PEN | 100 | B | B | B | Inv. |
| 26 | E | 2.00 | 1.10 | Lx-10 | Emulsion layer | 0.40 | PEN | 100 | B | B | B | Inv. |
| 27 | F | 2.00 | 1.10 | Lx-10 | Emulsion layer | 0.40 | PEN | 100 | B | B | B | Inv. |
| 28 | G | 2.00 | 1.10 | Lx-10 | Emulsion layer | 0.40 | PEN | 100 | B | B | B | Inv. |

Comp.: Comparative
Inv.: Inventive
* PET: polyethylene terephtharate
PEN: polyethylene-2,6-naphthalate As is apparent from Tables 1 and 2, it can be understood that, owing to the samples of the present invention, a silver halide photographic light-sensitive material wherein the occurrence of development unevenness and roller marks (pressure fogging and pressure desensitization) in the case of rapid processing in an automatic processing machine is prevented and there are no color residual.

What is claimed is:

1. A silver halide photographic light-sensitive material comprising a support having provided thereon a silver halide emulsion layer, and a protective layer provided on said silver halide emulsion layer, wherein said emulsion layer or said protective layer contains a polymer latex comprising a polymer having a repeating unit derived from a monomer having a solubility in water at 25° C. of not greater than 0.025% by weight, in an amount of 50% to 100% by weight, said support comprising polyethylene-2,6-naphthalate and having a thickness of 70 μm to 120 μm.

2. The material of claim 1, wherein said polymer of the latex is contained in said emulsion layer or said another layer in an amount of 0.2 g/m² to 2.0 g/m².

3. The material of claim 1, wherein said support comprises polyethylene-2,6-naphthalate having a intrinsic viscosity number of not lower than 0.4.

4. The material of claim 3, wherein said support comprises polyethylene-2,6-naphthalate having a intrinsic viscosity number of from 0.40 to 0.65.

5. The material of claim 1, wherein said support comprises polyethylene-2,6-naphthalate having a crystallization degree of 35% to 60%.

* * * * *